United States Patent [19]

Chianco et al.

[11] 4,413,362

[45] Nov. 8, 1983

[54] SITDOWN SHOWER FOR CHILDREN

[76] Inventors: Bernard V. Chianco; John B. Chianco; David B. Chianco, all of 1040 NE. 16th Ter., Fort Lauderdale, Fla. 33304

[21] Appl. No.: 328,824

[22] Filed: Dec. 9, 1981

[51] Int. Cl.[3] ..... A47K 3/022

[52] U.S. Cl. ..... 4/567; D23/35; 239/211; 4/615

[58] Field of Search ..... 4/567–570, 4/615–617; 239/211, 289; D23/35

[56] References Cited

U.S. PATENT DOCUMENTS

| | | | |
|---|---|---|---|
| D. 116,946 | 10/1939 | Freeman | 23/35 |
| 167,817 | 9/1875 | Bailey | 4/570 |
| D. 175,756 | 10/1955 | Becker | 23/35 |
| D. 224,532 | 8/1972 | Michels | 23/35 |
| 769,429 | 9/1904 | Caldwell | 4/568 |
| 1,175,454 | 3/1916 | Keller | 4/615 X |
| 1,322,753 | 11/1919 | Blair | 4/568 X |
| 1,336,034 | 4/1920 | Jensen | 4/567 |
| 1,383,987 | 7/1921 | Bellis | 4/567 |
| 1,724,147 | 8/1929 | Russell | 4/615 |

*Primary Examiner*—Charles E. Phillips
*Attorney, Agent, or Firm*—Oltman and Flynn

[57] ABSTRACT

The Sitdown Shower for Children enhances the capability of the standard bathtub by allowing a child to be showered in a sitting or lying posture in the middle of the tub. The shower is attached to the bathtub's tap by means of a sleeve adapter which fits in a glove-like manner over the downward projection of the tap. Rigid and self-supporting tubing extends from the adapter and projects the shower water to a moveable shower head connected to the far end of the rigid tubing. The lateral inclination of the shower head is slightly above the tap. In addition, horizontal and vertical suction cups are selectively located to brace the rigid tubing and provide added support for the tubing. The bathtub's hot and cold shutoff valves control the shower water and allow the temperature of the water to be adjusted.

3 Claims, 10 Drawing Figures

SITDOWN SHOWER FOR CHILDREN

BACKGROUND OF THE INVENTION

The present invention is directed to a novel and improved shower for installation in a household bathtub. The invention provides a means for adapting an installed household bathtub to provide shower capability for children. An extension device having one end connected to a water source and the other end attached to a shower head stretch this shower capability into the interior sections of the tub. In addition support members brace the extension device to allow the spray head to assume a mobile overhead inclination. Through the years several snap-on shower devices have been proposed.

For example, U.S. Pat. No. 1,327,428 to Gregory illustrates an adjustable shower spray device supported by a rigid rod in the longitudinal plane. The rigid rod is clamped to engage a faucet connection and at its opposite extremity projects a flexible metal tubing having a shower head attached.

U.S. Pat. No. 1,188,681 to Rosenberg shows a shower bath fixture for tubs having a semi-circular shape with perforations located along its interior surface. The fixture is attached to an external water supply and is positionable in the longitudinal plane along a vertical support.

U.S. Pat. No. 3,015,828 to Beebe demonstrates the use of a shower bath spray device affixed externally to a pump chamber which supplies water to the device. The opposite end of the spray device is attached to a spray head flexibly positionable.

U.S. Pat. No. 1,366,734 to Koehler presents combination of vertical and horizontal tubes connected through a collar with the farthest extension of the horizontal tubing affixed to a spray head and the near side of the vertical tubing molded into a jaw for clamping onto the bathtub rim intersected by a branch runner connected to the tap.

SUMMARY OF THE INVENTION

The present invention provides sitdown shower capability for children in a standard bathtub. A bathtub tap is connected to a flexibly positionable shower head through a combination of adapter and tubing, the adapter and tubing being fastened to a fixed position in the interior location of the tub in order to provide stability and firmness to this combination. Tap water is directed from the tap through the combination of adapter and tubing to the shower head by operating the hot and cold valves associated with the bathtub tap. The shower head is located at a level accommodating the placement of a child in a sitdown position under the shower head which is positionable to direct water on the child from the most advantageous location. Through the movement of the shower head and the adjustment of the hot and cold water valves the child can be washed in the most expeditious and efficient manner with due diligence given to the welfare of the child. The safety of the child is assured by the requirement that the child assume a sitting position and the capabilities of the tube extended by the ready adaption of the flexible sitdown shower to the standard bathtub tap. The sitdown shower can be removed as quickly as it is installed and gives added dimensions to the flexibility and use of the standard bathtub.

A principal object of this invention is to furnish a novel and improved means for quickly and efficiently extending the standard bathtub to a sitdown shower for a child.

Another object of this invention is to provide a sitdown shower with a moveable shower head which can be adjusted to the most advantageous position for directing the shower water onto the child sitting below the shower head.

Another object of this invention is to provide a sitdown shower for a child which is braced in a stable and firm manner so that it is not a safety hazard to the child located below the shower head.

Further objects and advantages of the present invention will be apparent from a detailed description of certain presently-preferred embodiments thereof shown in the accompanying drawings.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figure 1:
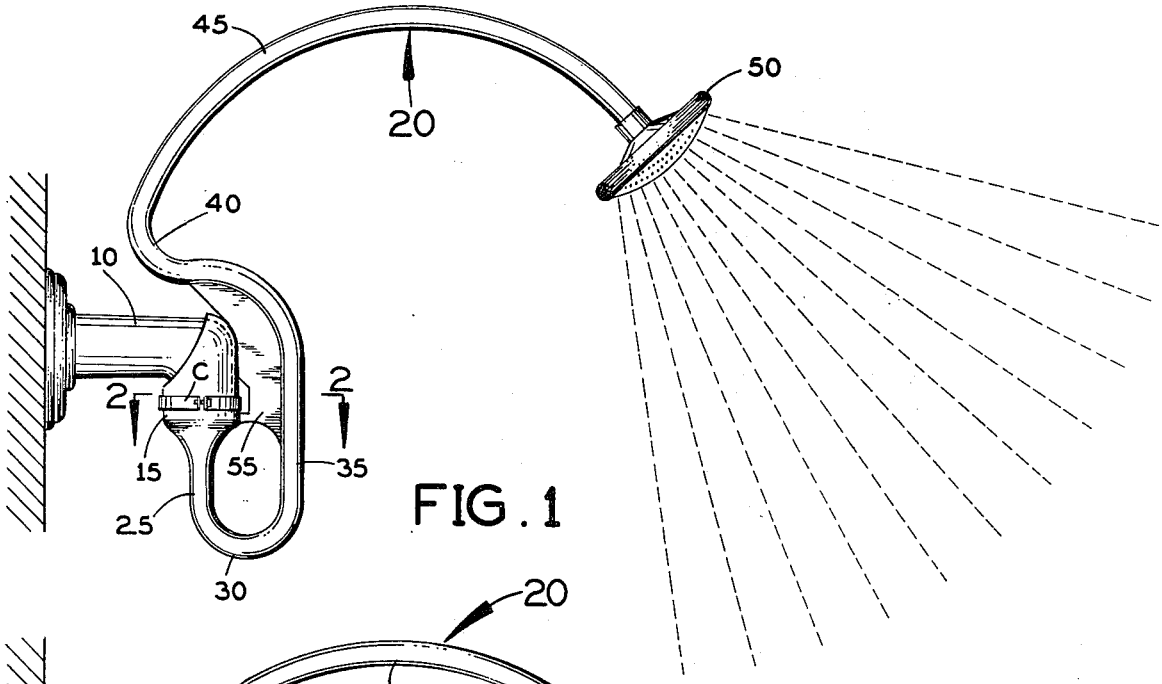
FIG. 1 is a latitudinal planar view of the sitdown shower for children detailing a plastic molded section composed of an adpater, a U-shaped rigid tube and an interior connector located between the adapter and the opposite vertical runner.
Figure 3:
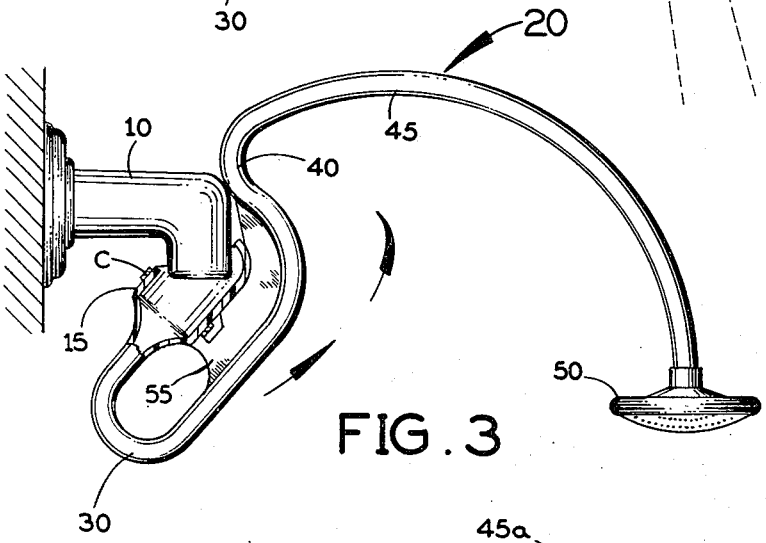
FIG. 3 is a view showing the attachment of the Sitdown Shower for Children of FIG. 1 being attached to the tap.
Figure 2:
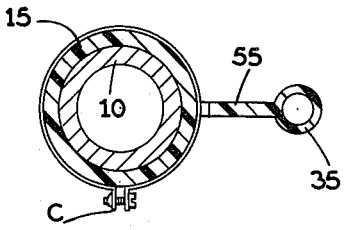
FIG. 2 is a longitudinal section view on 2—2 in FIG. 1 illustrating the plastic mold's adapter fitting snugly around the tap and attached to the opposite vertical runner.

FIG. 1 represents an embodiment of the Sitdown Shower for Children with the bathtub tap 10 snugly fitting into the adapter 15 of the rigid tube 20 which forms a one-piece plastic molded unit with adapter. The rigid tube 20 is composed of adapter 15 abutting downward vertical runner 25 which flows into U-shaped connector 30 and merges with the upward vertical runner 35 to continue into the S-curved runner 40 and finally joins the convex horizontal runner 45. In turn the convex horizontal runner 45 is secured to the moveable shower head 50. The rigid tube 20 projects tap water to the moveable shower head 50 located in the center of the bathtub. Between the adapter 15 and the backside of the upward vertical runner 35 a connector 55 (FIG. 2) is molded into the rigid tube 20. The sequence of steps required to attach this embodiment of the invention to the bathtub tap 10 is illustrated in FIG. 3.

Figure 4:
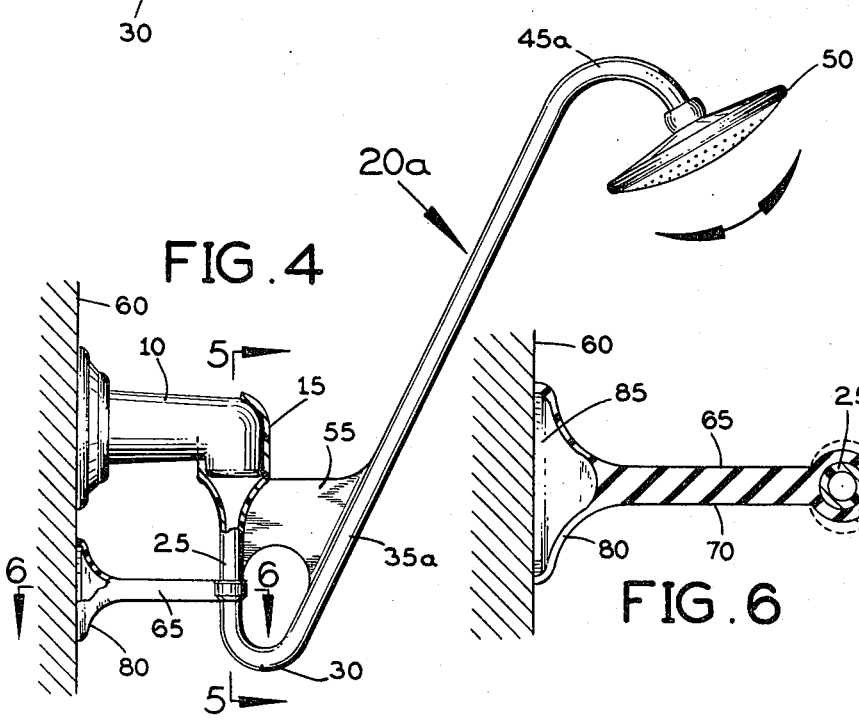
FIG. 4 is a view similar to FIG. 1 of a second embodiment, with the rigid tubing assuming a crisper angular inclination between bends and the vertical runner nearest the bath tub's sidewall being attached to this sidewall by a horizontal suction cup.
Figure 6:
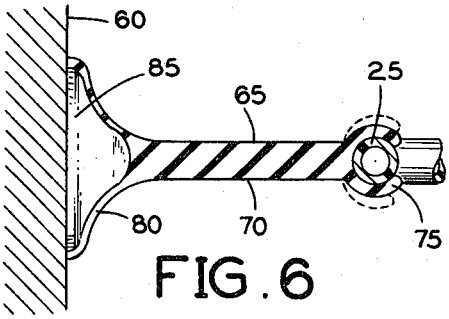
FIG. 6 is a latitudinal section view on 6—6 in FIG. 4 illustrating the bracing of the vertical runner by means of the extension of the horizontal suction cup.
Figure 5:
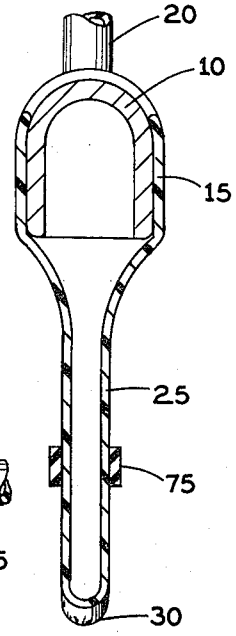
FIG. 5 is a longitudinal section view on 5—5 in FIG. 4 illustrating the seating of the tap in the plastic adapter.

FIG. 4 details a second embodiment of the invention with the tap 10 snugly fitted into the adapter 15 of the one-piece plastic molded rigid tube 20*a* (FIG. 5). Adapter 15 in this embodiment abuts the downward vertical runner 25 which flows into the U-shaped connector 30 and merges with the upward slanting runner 35*a* maintaining a substantially 60 degree angle with the horizontal and subsequently joins the shortened convex horizontal runner 45*a*. In turn the convex horizontal runner 45*a* is secured to the moveable shower head 50. Between the downward vertical runner 25 and the side of the bathtub 60 a horizontal suction cup 65 (FIG. 6) is attached. The horizontal suction cup 65 is composed of a base 80 which forms a hollow cavity 85 with the side of the bathtub 10 (FIG. 6). The suction formed by the cavity 85 is transmitted by the arm 70 to the collar 75 which encompasses the downward vertical runner 25 perpendicular to the intersection of the base 80 with the bathtub side 60.

Figure 7:
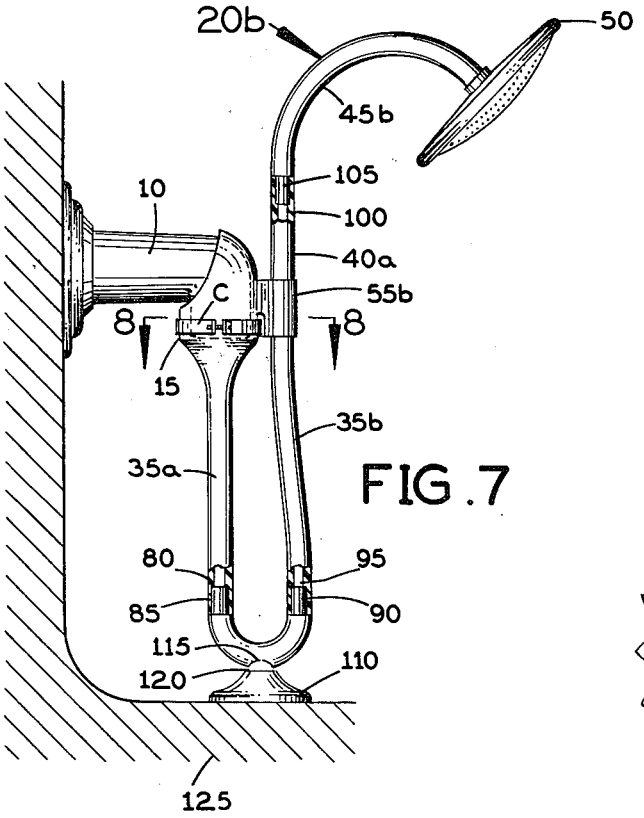
FIG. 7 is a latitudinal planar view of a third embodiment of the sitdown shower for children with the rigid tubing connected before and after substantially 90 and 100 degree bends by means of plastic threaded nut locks.
Figure 8:
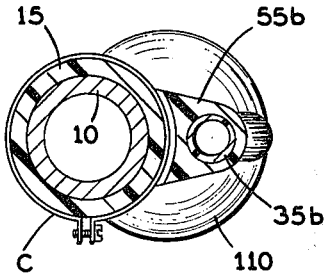
FIG. 8 is a longitudinal section on 8—8 in FIG. 7 illustrating the plastic mold's adapter fitting snugly around the tap and extending through a connector around the opposite vertical runner.

A third embodiment of the invention in FIG. 7 shows the tap 10 snugly fitted into the adapter 15 which forms a one-piece plastic molded unit with the downward vertical runner 25*a*. The runner 25*a* contains a plastic threaded nut lock receiver 80 on its lower extremity and joins a U-shaped connector 30*a* containing a plastic threaded nut lock fastener 85 on its near end and a plastic threaded nut lock receiver 90 on its far end. In turn an upward vertical runner 35*b* containing a plastic threaded nut lock fastener 95 at its lowest location joins the U-shaped connector 30*a* and continues vertically upward to terminate in vertical section 40*a* having a plastic nut lock receiver 100. A convex horizontal runner 45*b* joins vertical section 40*a* by means of a plastic threaded nut lock fastener 105 and on its opposite end is connected to moveable shower head 50. Collar 55*b* (FIG. 8) is molded with the adapter 10 and bracingly encompasses vertical section 40*a*. The lowest location 115 of U-shaped connector 30*a* intersects the top section 120 of vertical suction cup 110 which meets the horizontal surface 125 of the bath tap in a supporting manner.

Figure 10:
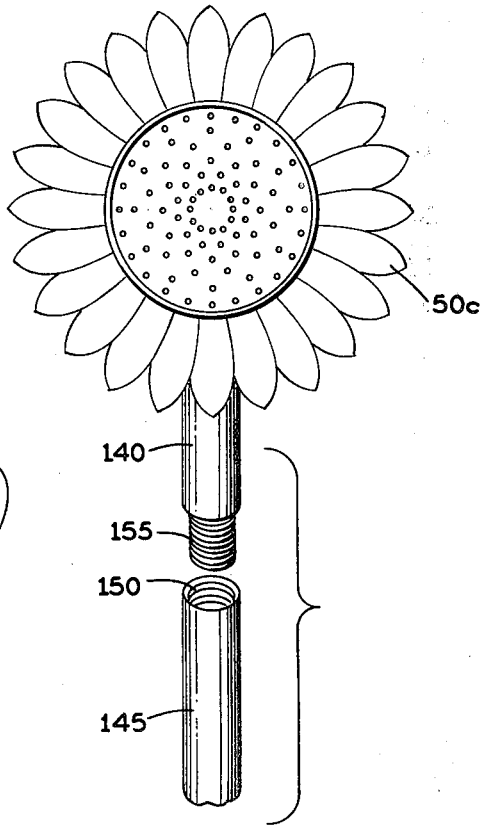
FIG. 10 is a fragmentary view illustrating a fanciful shower head connected by means of a plastic threaded nut lock to the end of the rigid tubing.
Figure 9:
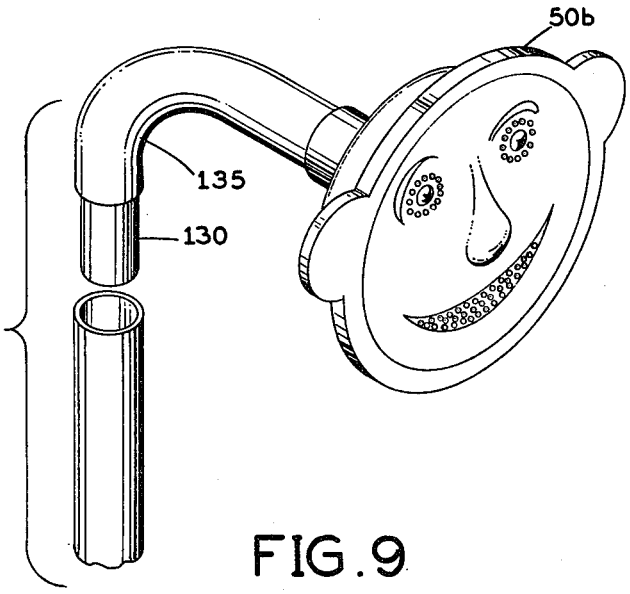
FIG. 9 is a fragmentary view illustrating a fanciful shower head connected to the end of the rigid tubing by means of a sleeve which forms a runner to the shower head.

FIG. 9 illustrates one mode in which the moveable 'Clown Face' shower head 50*b* joins the furthest rigid tube runner 130 of the invention. The feeder tube 135 of the moveable shower head 50*b* maintains an internal diameter which circumferentially engages in a sleeve-like manner the outer surface of rigid runner 130. An alternative mode has the moveable 'Sun Face' shower head 50*c* (FIG. 10) connected to feeder tube 140 and terminates in threaded fastener 155 which joins threaded receiver 150 located in the farthest runner 145. These fanciful shower heads can be used on all the embodiments.

The various embodiments of the present invention illustrate the novelty unobviousness and flexibility of the Sitdown Shower for Children. The standard bathtub tap is readily adaptable to attach the invention and provide shower capability for children. Once fastened to the tap the shower head is located in the central sections of the bathtub at approximately the same latitudinal displacement as the tap is from the base of the tub. The child in a sitdown or lying position is placed under the head and the head adjusted to facilitate the most productive manner of showering the child. The hot and cold shutoff valves utilized to adjust the bath water are available to control the shower water emanating from the shower head.

The adapter may be clamped on the faucet with a conventional clamp C as shown.

We claim:

1. For use in a bathtub having a water faucet which extends horizontally forward and then down to a water discharge opening, a shower assembly for releasable attachment to and support by said water faucet, said shower assembly comprising:

a hollow adapter with an open upper end which is slidably insertable on the faucet from below;

means for releasably clamping said adapter on the faucet to receive water from said water discharge opening in the faucet;

a rigid tube having one end attached integrally to the lower end of said adapter, said tube extending down from said adapter and then curving upward and forward and passing up in front of said adapter to an opposite end spaced above and in front of said adapter;

a shower head on said opposite end of said tube;

and a connector being integral with and extending between said adapter and said tube, forward of said adapter to said tube where the latter passes up in front of the adapter;

the mounting of said adapter on the faucet constituting the sole means of support for said tube, shower head and connector.

2. A shower assembly according to claim 1, wherein said shower head on the front depicts a face and has water discharge openings at features of said face and has outwardly extending rounded protrusions on opposite sides which simulate ears.

3. A shower assembly according to claim 1, wherein said shower head on the front has water discharge openings and a series of outwardly extending protrusions in succession circumferentially around said openings which simulate the petals of a flower.

* * * * *